United States Patent [19]

Summers

[11] 4,303,415

[45] Dec. 1, 1981

[54] GASIFICATION OF COAL

[75] Inventor: William A. Summers, Munster, Ind.

[73] Assignee: Lubille Energy Development Co., Ltd., Lansing, Ill.

[21] Appl. No.: 192,088

[22] Filed: Sep. 29, 1980

[51] Int. Cl.[3] ..... C10J 3/00

[52] U.S. Cl. ..... 48/202; 48/206; 48/210; 201/9; 201/44

[58] Field of Search ..... 48/210, 202, 203, 206; 201/9, 31, 44

[56] References Cited

U.S. PATENT DOCUMENTS

| | | | |
|---|---|---|---|
| 3,140,241 | 7/1964 | Work et al. | 201/9 |
| 3,375,175 | 3/1968 | Eddinger et al. | 201/31 |
| 4,056,443 | 11/1977 | Colletta et al. | 201/31 |
| 4,213,826 | 7/1980 | Eddinger et al. | 48/210 |

FOREIGN PATENT DOCUMENTS

| | | | |
|---|---|---|---|
| 2808571 | 8/1978 | Fed. Rep. of Germany | 48/202 |

*Primary Examiner*—S. Leon Bashore
*Assistant Examiner*—Michael Goldman
*Attorney, Agent, or Firm*—Philip Hill

[57] ABSTRACT

Coal is gasified, to yield a fuel gas having a medium-B.T.U. heating value, in the presence of air and steam in a plurality of reaction stages having different reaction temperatures. Reaction heat is principally supplied directly by recycle of char particles from a separate combustion zone to higher-temperature reaction zones and indirectly by combustion flue gas to lower-temperature reaction zones. Hydrogen sulfide, from product fuel gas, and flue gas are directly contacted to provide elemental sulfur. The only other product is a substantially non-combustible ash.

22 Claims, 3 Drawing Figures

GASIFICATION OF COAL

BACKGROUND OF THE INVENTION

Energy conservation in the presently existing social and industrial framework requires that increased attention be given to extensive coal resources as the available supplies of oil and gas from conventional sources are significantly diminished. Although many process schemes have been suggested and, in some instances, developed for the utilization of coal, environmental constraints have so far limited their consideration. The more capital intensive processes aim at providing a substitute for natural gas or for petroleum oils. Lower cost processes aim at gases having low to medium heating values. Often, such processes also yield a substantial amount of liquid fuel.

In the gasification of coal, heat is supplied largely by combustion of a portion of the coal. Typically, the combustion is effected by introducing air into the gasifying vessel. This necessarily leaves the inert gases from the air stream and from the combustion process in the product gas as a diluent, so that the heating value of the product fuel is markedly decreased. Additionally, environmentally undesirable oxides of nitrogen are produced. This effect can be avoided by the use of elemental oxygen, but this requires the addition of an oxygen plant and, of course, increases investment and operating costs. In another approach, coal particles are burned separately and the hot coke particles (from partial combustion) or ash particles (from substantially complete combustion) are introduced indirectly into the gasification vessel. This latter approach often requires very high combustion temperatures in the range of 3000°-3500° F.

Where multiple coal pyrolysis and gasification steps are employed, product gases generally provide heat for lower-temperature zones by countercurrent flow of product gases. In such instances, a char product, comprising up to about one-half of the carbon value of the coal feed, is usually produced.

The use of hot particles from a separate combustion zone as the heat source is described in U.S. Pat. No. 4,017,432, where coal char particles or extraneous solids particles may be employed as heat carriers. The use of countercurrent flow of gas for heating prior reaction stages is described, for example, in U.S. Pat. No. 3,375,175.

Most of the proposed gasification processes operate at elevated pressures, ranging from about 100 p.s.i.g. to over 3,000 p.s.i.g. Most low-pressure processes convert coal incompletely, providing coal char as a major product, or provide a gas having a low heating value.

There remains a need for a low-pressure low-temperature process which can effect a substantially complete conversion of carbon values in the coal while gasifying a maximum proportion of the carbon as well as the more-volatile coal components. There likewise remains a need for the effective removal of sulfur from product gas and combustion flue gas streams. Where these goals can be met, there will be provided the opportunity to employ conventional reaction vessels with simple metallurgical requirements. There will also be provided an economically attractive source of fuel gas to existing industrial locations presently faced with the need for extensive and expensive non-productive installations required in order to meet environmental standards, particularly for air and water quality.

SUMMARY OF THE INVENTION

The process of this invention provides, as environmentally acceptable products from a sulfur-containing coal, a fuel gas product, having a medium-B.T.U. heating value, and a substantially non-combustible ash. Much of the heat for the gasification process is supplied by combustion of a portion of the coal char after the volatiles present have been removed and gasified. Hot char particles are recirculated to calcination and gasification stages while combustor flue gas is employed to heat prior devolatilization stages.

It is an object of this invention to provide a medium-B.T.U. heating value product without need for a process source of highly concentrated elemental oxygen.

It is a further object of this invention to provide a process adaptable for use with a broad range of coal types and sources.

It is a further object of this invention to provide a process wherein coal volatilization products are effectively completely converted to gaseous fuel products.

It is a further object of this invention to provide a process wherein the respective heat sources may be employed in an optimal manner to increase the yield and heating value of the gaseous fuel product.

A still further object of this invention is the provision of a simplified sulfur recovery process, incident to the gasification process, whereby hydrogen sulfide is recovered from product fuel gas and reacted directly with flue gas to remove sulfur dioxide therefrom.

DETAILED DESCRIPTION OF THE DRAWINGS

Figure 1:
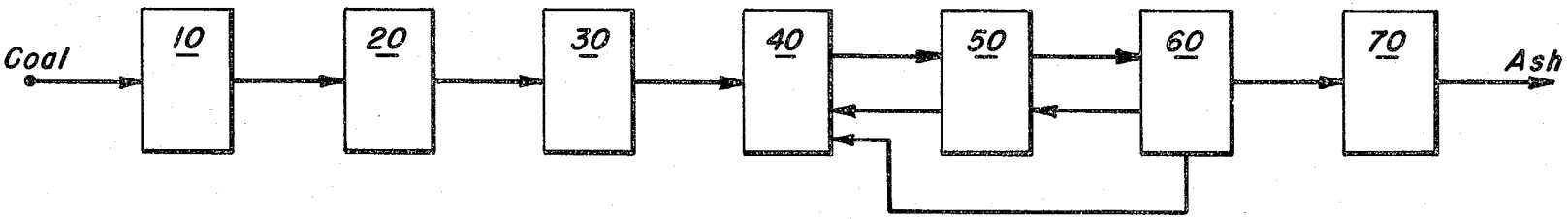
FIG. 1 sets forth a general flow pattern for coal and/or char solids in the process of this invention.

With reference to FIG. 1, a generalized flow pattern for coal solids proceeds directly from drier 10 through the remaining vessels, respectively, heat treater 20, devolatilizer 30, calciner 40, gasifier 50, heat generator 60, and agglomerator 70. Provision is made for return of solids from gasifier 50 to calciner 40 and from heat generator 60 to either or both of gasifier 50 or calciner 40. Moisture, volatiles, and solid carbon-containing components of the coal feed are recovered and/or converted in the course of the process, leaving an ash residue for disposal.

Figure 2:
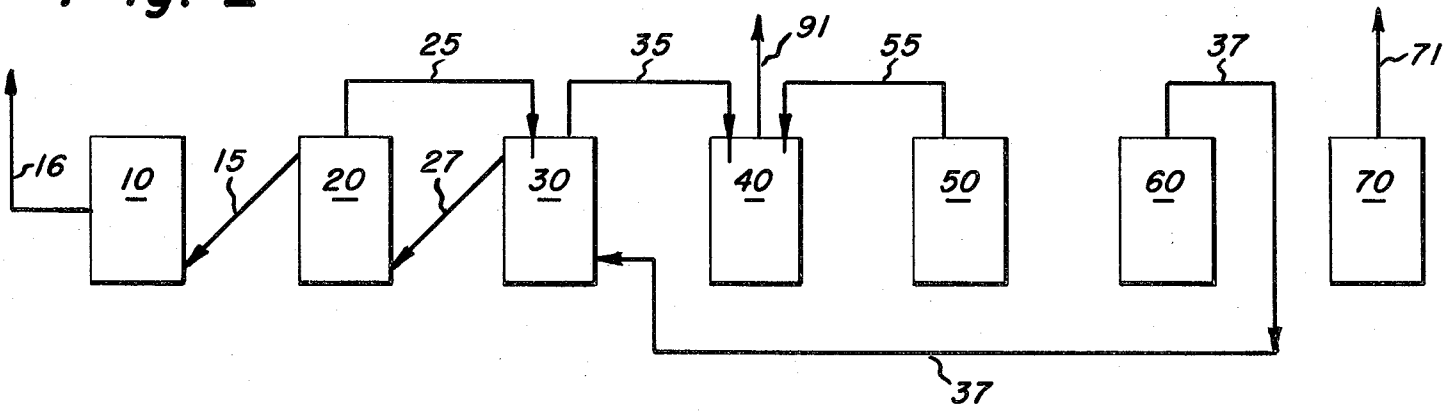
FIG. 2 sets forth a general flow pattern for the major fuel gas and flue gas streams in the process of this invention.

With reference to FIG. 2, generalized flow patterns for gaseous products proceed variously among the respective reaction vessels, designated and numbered as in FIG. 1. For convenience, the respective gas streams are numbered as in the accompanying FIG. 3. Volatiles from heat treater 20 flow to devolatilizer 30 through line 25 and the combined volatiles to calciner 40 through line 35. Gases from gasifier 50 similarly flow to calciner 40 through line 55. Product fuel gas is withdrawn through line 91. Flue gas from heat generator 60 passes through line 37 for use as a heat source, serially in devolatilizer 30, heat treater 20, and drier 10, passing into the latter vessels through lines 27 and 15, respectively, prior to withdrawal through line 16. Depending upon the mode of operation, either producer gas or flue gas is withdrawn from agglomerator 70 through line 71 and, if desired, combined with other appropriate product streams.

Figure 3:
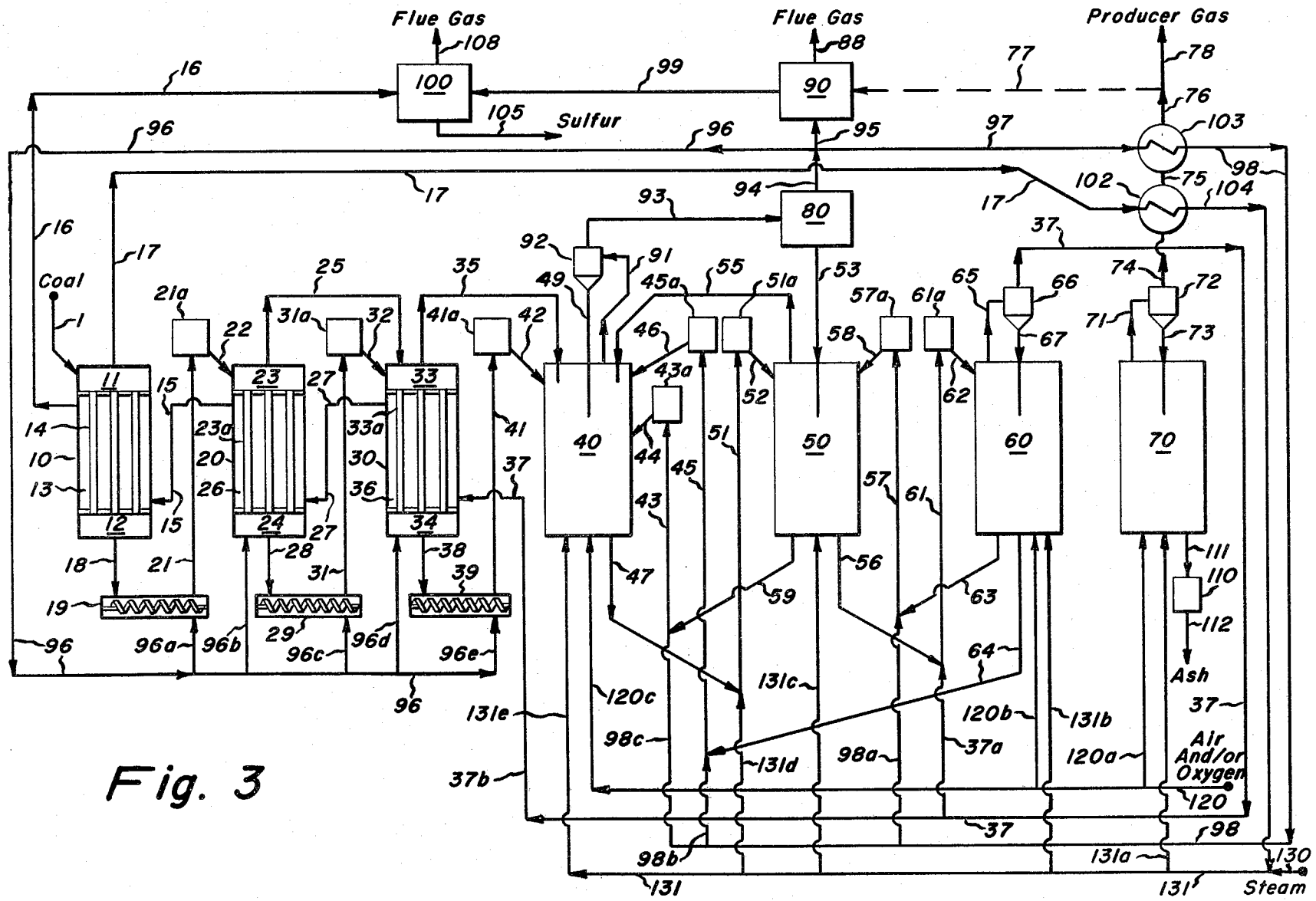
FIG. 3 sets forth a detailed flow diagram in accordance with one preferred embodiment of the process of this invention.

FIG. 3 is exemplary, without limitation, of one embodiment of the process of the invention, wherein the products are a fuel gas of medium heating value, a producer gas of lesser heating value, sulfur, and an ash containing substantially no combustible matter. Additionally, an environmentally acceptable flue gas stream, having a suitable low sulfur content, is discharged to the atmosphere.

With reference to FIG. 1, coal is ground to pass through a 4-mesh screen and introduced through line 1 into retort-type drier 10. The coal is received in plenum 11 and passes downwardly through tubes 14 into collecting zone 12. The tubes 14 are heated by indirect heat exchange with flue gas, passing from line 15 into heating zone 13 and finally into exit line 16. Steam generated from heating and drying of the coal particles is withdrawn through line 17. Dried coal particles are discharged through line 18 and screw conveyor 19.

The dried coal particles are then passed upwardly through lift line 21, expansion zone 21*a*, and line 22, with product fuel gas as the transport medium supplied through lines 96 and 96*a*, into heat treater 20. The heat treating vessel 20 is of the retort type, similar to drying vessel 10, and heated by indirect heat exchange with flue gas entering through line 27 into heating zone 26 and finally being withdrawn to the drier 10 through line 15. The dried coal particles enter plenum 23 and gradually pass downwardly through the retort tubes 23*a* where some volatile products are formed, passing upwardly through plenum 23 and line 25. Fluidizing product gas may be supplied as desired through lines 96 and 96*b*. The heat treated coal particles pass by gravity into collecting zone 24 and are discharged through line 28 and screw conveyor 29.

The heat treated coal particles are then passed upwardly through lift line 31, expansion zone 31*a*, and line 32, with product fuel gas as the transport medium supplied through lines 96 and 96*c*, into devolatilizer 30. The devolatilizing vessel 30 is likewise of the retort type, heated by indirect heat exchange with flue gas, supplied through lines 37 and 37*b* to heating zone 36 and finally being withdrawn to the heat treater 20 through line 27. With the devolatilizer 30 being maintained at a substantially higher temperature, the heat treated particles introduced into plenum 33 exhibit a substantial thermal decomposition therein as well as while passing through retort tubes 33*a*. Fluidizing product gas may be supplied as desired through lines 96 and 96*d*. The decomposition reactions provide a mixture of gases, oils and tars which are combined with volatile products received through line 25, the volatile portion being taken overhead through line 35. The devolatilized coal particles now constitute a coal char, whose particles are collected by gravity flow through retort tubes 33*a* into collecting zone 34 for discharge through line 38 and screw conveyor 39.

The coal char particles are next passed into the calciner zone 40 through lift line 41, expansion zone 41*a*, and line 42. Product fuel gas is employed as the transport medium, supplied through lines 96 and 96*e*. Devolatilizer gases are introduced into the calciner through line 35. The calciner vessel 40 is heated either by direct combustion of a portion of the coal char, by direct heat exchange with recycled hot solid particles, by superheated steam, or by a combination of any or all of these means. For combustion purposes, an oxygen-containing gas, which may be air, elemental oxygen, or a combination thereof, is introduced into the bottom of calciner 40, as desired, through lines 120 and 120*c*. As desired, steam is introduced similarly through lines 131 and 131*e*. Hot recycle coke particles are supplied, as desired, through lines 44 and 46, as later described. Thermal cracking, particularly of coal decomposition oils and tars, steam cracking, and reforming reactions all occur in the calcination stage, to provide a medium-B.T.U. gas stream which is withdrawn through line 91 into cyclone separator 92 and finally through line 93 to further processing. Char fines are returned from cyclone separator 92 through line 49. The calcined char particles, having passed downwardly through vessel 40, now constitute a coke and the particles are discharged through line 47.

The calcined coke particles are transferred through line 47, lift line 51, expansion zone 51*a*, and line 52 into gasifier vessel 50. Steam is provided through lines 131 and 131*d* to serve as a transport medium. Steam, for coke gasification reaction, is chiefly supplied through lines 131 and 131*c* into the bottom section of gasifier 50. The gaseous reaction products are passed into the upper zone of calciner 40 through line 55. The coke particles pass downwardly through gasifier 50 and are discharged as carbon-lean coke particles primarily through line 56. Some, usually a minor portion, of the carbon-lean coke particles are returned to calciner 40, to provide heat therefor, through line 59, lift line 43, expansion zone 43*a*, and line 44, with product fuel gas, supplied through lines 97, 98 and 98*c*, as the transport medium.

A major portion of the carbon-lean coke particles are taken from line 56 through lift line 61, expansion zone 61*a*, and line 62, into heat generator 60. Flue gas is supplied, through lines 37 and 37*a*, as a transport medium. In vessel 60 much of the remaining carbon is burned to provide heat for the preceding reactions. Air for combustion is supplied through lines 120 and 120*b*. Provision is also made for injection of steam through lines 131 and 131*b*. Hot flue gas passes upwardly from heat generator 60 through line 65 and cyclone separator 66 into line 37. Fine solids, entrained in the flue gas stream, are returned to heat generator 60 from separator 66 through line 67. The hot flue gas is supplied through line 37 for use as a transport medium (line 37*a*) and as a reaction heat source (line 37*b*), as previously described.

Heated coke particles, supplying heat for the steam gasification reactions, are mainly transferred through line 63, lift line 57, expansion zone 57*a*, and line 58, into gasifier 50. Product fuel gas, supplied through lines 97, 98 and 98*a*, serves as the transport medium.

As desired, heated coke particles may also be transferred to calciner vessel 40 to replace a portion of the heat requirement therefor, otherwise supplied by combustion of char, hydrocarbons, or calciner gas with air or oxygen. For this purpose, heated coke particles are transferred through line 64, lift line 45, expansion zone 45*a*, and line 46 into calciner 40, with product fuel gas, supplied through lines 97, 98 and 98*b*, employed as the transport medium.

A minor portion of the heated coke particles are also withdrawn regularly and sent through line 69 to agglomerator vessel 70. Here, remaining carbon is converted, as by combustion with air to provide a second flue gas stream, or preferably, by reaction with air and steam to yield a producer gas stream. In the latter embodiment, air is supplied to the agglomerator 70 through lines 120 and 120*a*, while steam is provided through lines 131 and 131*a*. A substantially carbon-free slag accomulates in the bottom section of the agglomerator and is withdrawn through line 111 to quenching vessel 110, supplied with water, not shown, and finally provided through exit line 112 as a substantially non-combustible ash.

Hot producer gas is withdrawn through line 71, cyclone separator 72 and line 74 for further processing. Fines are returned to the agglomerator 70 through line 73.

The product gas stream from calcination and gasification is taken through line 93 to separator zone 80 for cooling and/or scrubbing with water, to remove liquid and tarry components from the gas. Such components are passed through line 53 to gasifier 50 for reaction with steam to provide additional fuel gas.

The hot producer gas stream (line 74) is cooled by indirect heat exchange with steam (line 17) in exchanger 102, passed through line 75, and further cooled by indirect heat exchange with a recycle stream of product gas (line 97) in exchanger 103, before being withdrawn, through lines 76 and 77 for further processing, or through 78 for storage or use.

Medium-B.T.U. gas is withdrawn from separator 80 through line 94, with minor portions being recycled through lines 96 and 97 and the major portion sent through line 95 to amine-scrubber system 90 for removal of acid gases, particularly hydrogen sulfide. The desulfurized gas fuel product is then withdrawn through line 88 for storage or use.

When desired, the producer gas stream may be sent through line 77 to the amine-scrubber 90 and withdrawn in mixture with the product gas stream to provide a low-sulfur product gas having a somewhat lower heating value still within the medium-B.T.U. range.

Hydrogen sulfide recovered in amine-scrubber system 90 is passed through line 99, and flue gas, containing sulfur dioxide, through line 16, and mixed in sulfur generator 100. Elemental sulfur product is withdrawn through line 105. Desulfurized flue gas is discharged to the atmosphere through line 108.

Steam is partially supplied from conventional waste heat boilers, not shown, and collected in line 130 for combination with heated steam (from exchanger 102) in line 104 to provide process reaction steam through line 131.

Air and/or oxygen is supplied in whatever proportions desired for combustion process reaction through line 120.

All of the products derived from the process scheme illustrated in the drawing are environmentally acceptable.

EMBODIMENTS OF THE INVENTION

The process of this invention, in its various embodiments, provides an effective means for converting coal to gaseous fuel products, particularly to gaseous fuels having heating values in the medium B.T.U. range. A typical gaseous fuel of this invention will have a heating value generally within the range from about 250 to about 750 B.T.U./s.c.f. and usually within the range from about 300 to about 500 B.T.U./s.c.f. The gas product will possess a very low sulfur content such that its use in combustion processes will not contribute to pollution problems but rather serve to maintain or to enhance the environmental quality of the atmosphere. In one embodiment of this invention there is also provided a producer gas stream, having a substantially lower heating value, for separate use or for admixture with the product fuel gas.

The process of this invention typically converts substantially all of the carbon values in the coal to gaseous products, leaving an ash product containing typically no more than about 0.5 wt. % carbon. Such a substantially non-combustible ash product can be readily disposed of in any conventional manner, such as in landfills, with no environmental detriment. The ash product is also an attractive component of newly-developed building materials.

This invention process achieves a high degree of thermal efficiency such that the gross heating value derived from a unit of coal feed is highly attractive for use in most commercial situations. The process is particularly adaptable for use with existing power supply systems where coal must be replaced as a fuel due to environmental constraints and more conventional options for use of gaseous or liquid fuels are not economically attractive.

This inventive process is suitable for use with a broad range of coal types, including anthracite, bituminous and sub-bituminous coals, lignites, and peat. It may similarly be employed with other solid carbonaceous materials such as coke, petroleum coke, and dried sludges. It may be employed with either high- or low-sulfur coals and is particularly suitable for use with problem coals such as Illinois No. 6.

A representative analysis of an Illinois No. 6 coal includes:

| | |
|---|---|
| Moisture | 10 wt. % |
| Volatiles | 37 wt. % |
| Fixed Carbon | 43 wt. % |
| Ash | 10 wt. % |

The coal will contain about 3.0 wt. % total sulfur and have a heating value of approximately 11,400 B.T.U./lb. When employed in the process of this invention, there will be provided from about 30 to about 50 MCF/ton of product fuel gas with an efficiency of about 80% (100 X B.T.U. in fuel gas/B.T.U. in coal feed).

The inventive process is designed to operate at low superatmospheric pressures, in the range from about 5 to about 50 p.s.i.g., preferably from about 10 to about 25 p.s.i.g. Gas flows throughout the system are generally balanced to provide optimal and low pressure drops while driving the solids flow through the system. Booster compressors (or exhausters) may be employed without effect on the essential features of the process.

Coal particles for use in this process must be fine enough to be readily transferable by pneumatic means with gas lift systems. Prior to drying, coal is ground to comprise particles smaller than ¼ inch in diameter, and generally of a size to pass through a 4-mesh screen and be retained on a 50-mesh screen. The process steps of this invention generally eliminate problems associated with the clumping, or sticking, of particles which may arise in conventional processing of the lower grades of coal.

In preferred embodiments of the invention coal particles are ground to pass through a 4-mesh screen and delivered through a lock-hopper arrangement into a drying vessel of the retort type. Coal particles are received into an upper plenum section of the drier and pass downwardly through a series of tubes into an associated collecting zone. The coal-containing section of the drier is heated by passage of hot flue gas, from a subsequent process stage, through the shell side of the retort. Coal particles enter the drier at ambient temperature and, in the course of drying, are warmed to a temperature within the range from about 220° to about 300° F., preferably from about 260° to about 270° F. Moisture liberated from the coal is discharged from the plenum as steam, at a temperature within the described range, for subsequent use in the gasification process.

Dried coal particles are first subjected to mild heat treatment in a retort-type vessel, similar in design to the drier and likewise heated with hot flue gas. In the heat treating zone, the temperature is maintained generally within the range from about 400° to about 700° F., and preferably within the range from about 550° to about 675° F. At such temperatures the most volatile components of the coal and the first thermal decomposition components are liberated and pass upwardly through the retort tubes and plenum area, stripping additional volatile components from the coal. The volatile components and the heat-treated coal particles are separately withdrawn from the heat treating stage and transferred to the devolatilizing stage.

The devolatilizer comprises a retort-type vessel, heated as before with hot flue gas to provide a process temperature generally within the range from about 850° to about 1150° F., and preferably within the range from about 900° to about 1100° F. At these temperatures less volatile components of the coal, together with additional thermal decomposition products, are liberated and pass upwardly into the plenum area of the retort for mixing with the volatile products transferred from the prior heat treating stage. The thermal loss of the volatile materials converts the coal particles into a char-type material as they pass downwardly through the retort tubes and are withdrawn through the collecting zone of the retort for transfer to the calcining stage. The combined volatile products are separately transferred to the calcining stage. The combined volatile products are separately transferred to the calcining stage.

In a typical operation, about 10 wt. % of the coal will be lost to moisture in the drying stage, together with about 35 wt. % as the various volatile and thermal decomposition components. Accordingly, the coal char particles fed to the calcining operation usually constitute about 55 wt. % of the original coal feed. Up to this stage of the process, solid and vapor products have moved co-currently with all process heat being supplied externally of the reactants by indirect heat exchange with process flue gas. Although flue gas may be separately employed to heat the retort reactors, a preferred flow arrangement comprises directing the flue gas stream serially through the devolatilizing stage, the heat treating stage, and finally the drying stage. In any event the total cooled flue gas stream, still above the dewpoint temperature, is ultimately collected for further environmental processing.

The calcining stage comprises an expanded bed reactor, generally maintained at a reactor bed temperature within the range from about 1550° to about 1750° F., preferably from about 1600° to about 1675° F. In the calciner, coal char particles are heated in the presence of steam and an oxygen-containing gas, which may be air, elemental oxygen, or a combination thereof. Heat for the calcination stage is supplied variously by superheated steam, combustion of a portion of the char within the calciner vessel, and recycle transfer of hot char particles into the calciner stage from hotter downstream stages of the process. The volatile products from the preceding stages and the char particles are separately introduced into the upper zone of the calciner. Steam and/or oxygen-containing gas are introduced into the lower zone of the calcining stage.

Combustion in the presence of steam leads to the formation of carbon oxides, particularly carbon monoxide, and elemental hydrogen. On balance, there is a substantial evolution of heat despite the endothermic nature of hydrogen-producing reactions. The various volatile components also react further as by thermal cracking, hydrocracking, and steam reforming reactions.

The calciner gas stream, comprising substantial amounts of carbon monoxide, hydrogen and methane, is withdrawn from the upper zone of the calciner stage for further processing. The carbon-rich char particles, having gradually moved downwardly through the reactor, are withdrawn from the lower zone of the calciner and transferred to the gasification stage.

The gasifying stage comprises an expanded bed reactor, generally maintained at a reactor bed temperature within the range from about 1650° to about 1950° F., preferably from about 1850° to about 1950° F. The gasifying stage is heated with hot recycle char or coke particles from the downstream heat generation stage. Typically, maintenance of the preferred temperature level in the gasifier requires the cycling of hot particles at a rate within the range from about 25 to about 40, preferably from about 30 to about 35, volumes per gasifier bed volume per hour. Char and/or coke particles, from either the calcining stage or the heat generating stage, are introduced into the upper zone of the gasifier. Superheated steam is introduced into the lower zone for reaction and fluidization purposes. Steam reacts with carbon to form water gas as the principal reaction, such that a total of from about 20 to about 30 wt. %, preferably from about 25 to about 30 wt. %, of the original coal is converted to product gases in the calcining and gasifying stages.

Product gas from upper zone of the gasifier stage is withdrawn to the calciner stage and mixed with the other product gases, for further reaction and subsequently for downstream processing.

Hot carbon-lean char or coke particles are withdrawn from the lower zone of the gasifier stage for transfer, either as a heat source to the calciner stage, or for combustion to the heat generator stage.

The heat generating stage comprises a combustion vessel wherein air is supplied for reaction with a substantial portion of the remaining carbon, such that combustion bed temperature will be above about 2000° F. and generally within the range from about 2100° to about 2200° F. Provision may also be made for the introduction of steam as required for temperature control. Hot flue gas from the heat generating stage is employed in the heating of the devolatilizing, heat treating, and drying stages, as described above. A major portion of the hot coke particles is recycled to the gasifying stage and a second portion is optionally recycled to the calcining stage, in each instance to provide process heat. A small portion of the coke particles is continuously removed to a final agglomeration stage.

In the agglomeration stage residual carbon is substantially completely converted to provide a hot slag product which, after cooling, is withdrawn for disposal as a substantially non-combustible ash. Typically, the ash product contains no more than about 0.5 wt. % carbon. The slag may be cooled by quenching with water or steam to provide a friable residue. The heat-exchanged steam may be employed by injection into earlier process stages, as, for example, the gasifying stage.

Conversion in the agglomeration stage may be by combustion of residual coke or by production of producer gas. In the former mode air is introduced into the vessel and a hot flue gas stream is withdrawn for combination with the heat generator flue gas stream or for separate downstream processing. In the latter mode, air and steam are introduced into the vessel simultaneously to provide a fuel gas, having a low heating value generally within the range from about 100 to about 150 B.T.U./s.c.f. The producer gas stream may be recovered as a separate fuel gas stream for further processing, combined with the calciner gas stream, or burned within battery limits as an additional source of process heat. In either mode of conversion, provision can be made for optimized heat exchange with other process streams or for steam generation.

With reference to the respective fuel gas streams from the devolatilizer and gasifier, brought together with the calciner gas under conditions for further reaction within the calciner stage, the composite product is withdrawn from the upper zone of the calciner stage and passed to a separator zone for cooling, as by water scrubbing, and separation of high-boiling oils and tars present in the volatile matter and not fully converted to normally gaseous products. The recovered tars and oils are introduced into the gasifier stage for substantially complete conversion.

Typical heating values and compositions of the various gas streams, to be anticipated when employing Illinois No. 6 coal as feedstock, are presented in the following tabulation.

| Gas Source | Heating Value, BTU/CF | Components (N-free basis) | | | |
|---|---|---|---|---|---|
| | | $CH_4$ | $H_2$ | CO | Other |
| Devolatilizer | 945 | 44 | 7 | 13 | 36 |
| Calciner | 410 | 17 | 47 | 23 | 13 |
| Gasifier | 310 | 1 | 44 | 30 | 25 |
| Agglomerator | 135 | — | 12 | 28 | 60[a] |

[a]Includes nitrogen.

Portions of the product gas, after cooling and scrubbing, are recycled, as desired, for use as fluidizing gas for mixing or as lift gas for solids transport in the various process stages, particularly as set forth, for example, in FIG. 3. The major portion of the product gas is sent to an amine scrubber for separation and recovery of acid gas impurities, principally hydrogen sulfide. When producer gas is generated, it may be treated similarly in the same or a separate amine scrubbing system. The final product fuel gas, which may include the producer gas stream, is withdrawn for storage or use as a low-sulfur, medium-B.T.U. fuel, having an unusually wide range of utility.

The recovered hydrogen sulfide is mixed with the flue gas stream, or streams, for reaction with the sulfur dioxide contained therein. Elemental sulfur product is recovered by conventional means. In a typical embodiment of this invention, the reactive sulfur contained in the coal feed is partially converted in each of the gas-producing stages (total conversion about 67%) and in the combustion stages (total conversion about 33%) so that the feed to the sulfur generator comprises substantially stoichiometric proportions of the respective reactants. Where there is a deficiency of sulfur dioxide in the gas feed to the sulfur generator, an appropriate quantity of sulfur product may be provided to the heat generator stage for combustion therein.

The process of this invention provides for the production of a medium-B.T.U. fuel gas from coal, employing only air as an oxidizing gas. The process air is utilized principally in isolation from the gasification and reforming reactions so that dilution of the fuel gas with inert components of air and with inert combustion products is minimized. Process heat is utilized efficiently, as by indirect heating with flue gas and by direct heating with hot char provided to both the calcining and the gasifying stages. Process conditions surprisingly provide for efficient fuel gas production, while permitting the use of readily available metallurgy and process equipment. Environmental constraints are readily met inasmuch as atmospheric pollutants are minimized and very little process water cleanup is necessary.

I claim:

1. The process of gasifying clean coal particles at a low superatmospheric pressure, wherein the coal particles are converted to a gaseous fuel product and a substantially non-combustible ash in a series of elevated-temperature stages, comprising the steps of:

(a) drying the coal particles, in a drying stage at a temperature within the range from about 220° to about 300° F., in indirect heat exchange with a flue gas stream;

(b) transferring the dried coal particles to a heat treating stage and heat treating the dried coal particles therein at a temperature within the range from about 400° to about 700° F., in indirect heat exchange with a flue gas stream;

(c) transferring the heat-treated coal particles to a devolatilizing stage and devolatilizing the heat-treated coal particles therein at a temperature within the range from about 850° to about 1150° F., in indirect heat exchange with a flue gas stream, to yield an overhead volatiles stream and devolatilized coal char particles;

(d) transferring the devolatilized coal char particles, to a calcining stage and calcining the devolatilized coal char particles therein at a bed temperature within the range from about 1550° to about 1750° F., in contact with steam and a gaseous stream comprising an oxygen-containing gas, to yield an overhead calciner effluent gas stream and carbon-rich calcined coke particles;

(e) transferring the calcined coke particles to a gasifying stage and gasifying the calcined coke particles at a bed temperature of at least about 1650° F., in contact with steam, to yield an overhead gasifier gas stream and carbon-lean coke particles;

(f) transferring the overhead volatiles stream and the overhead gasifier gas stream to an upper zone of the calcining stage, whereby the respective streams and the calciner gas react further in contact with steam and the oxygen-containing gas and are mixed to form the calciner effluent gas stream;

(g) cooling, and optionally scrubbing, the calciner effluent gas stream to provide a normally liquid condensate fraction and a gaseous fuel product stream;

(h) transferring the normally liquid condensate fraction to the gasifying stage;

(i) transferring the carbon-lean coke particles to a heat generating stage and generating heat therein by combustion of a portion of the coke in contact with a gaseous stream comprising air, to provide heated coke particles and the flue gas stream;

(j) transferring a major portion of the heated coke particles to the gasifying stage, whereby requisite heat is supplied for the gasification of calcined coke particles and heated coke particles;

(k) withdrawing a minor portion of the heated coke particles to an agglomeration stage, wherein substantially complete conversion of residual coke to ash and a gas is effected; and (l) discharging from the agglomeration stage a substantially non-combustible ash.

2. The process of claim 1 wherein the oxygen-containing gas is selected from the class consisting of air, elemental oxygen, and mixtures thereof.

3. The process of claim 1 wherein a portion of the heated coke particles are transferred from the heat generating stage to the calcining stage, whereby a portion of the requisite heat for calcining is provided.

4. The process of claim 1 wherein a portion of the carbon-lean coke particles are transferred from the gasifying stage to the calcining stage, whereby a portion of the requisite heat for calcining is provided.

5. The process of claim 1 wherein at least a portion of the requisite heat within the devolatilizing, heat treating, and drying stages is provided by serial indirect heat exchange with the flue gas stream.

6. The process of claim 1 wherein a portion of the gaseous fuel product stream is diverted to provide a first recycle gas stream, for use as a transport medium for coal or char particles, respectively, to the heat treating stage, the devolatilizing stage, and the calcining stage.

7. The process of claim 1 wherein a portion of the gaseous fuel product stream is diverted to provide a second recycle gas stream for use as a transport medium, for coke particles, respectively, to the calcining and gasifying stages.

8. The process of claim 1 wherein heated coke particles in the agglomeration stage are contacted with air and steam at a temperature of at least about 1900° F., whereby substantially complete gasification of the residual coke occurs, to provide a producer gas stream and a substantially non-combustible slag stream.

9. The process of claim 8 wherein the producer gas stream is cooled in indirect heat exchange with the second recycle gas stream.

10. The process of claim 8 wherein the slag stream is cooled, at least in part in heat exchange with steam intended for injection into the gasifying stage, to provide a friable, substantially non-combustible ash.

11. The process of claim 8 wherein the producer gas stream is burned to provide additional flue gas for steam generation and heat exchange purposes.

12. The process of claim 1 wherein heated coke particles in the agglomeration stage are contacted with air, whereby substantially complete combustion of the residual coke occurs, to provide a second flue gas stream and a substantially non-combustible ash.

13. The process of claim 1 wherein the recovered gaseous fuel product stream is treated in an amine-scrubber system, selected to remove and recover at least a major portion of the hydrogen sulfide present therein and to provide an environmentally acceptable gaseous fuel product stream.

14. The process of claim 12 wherein the recovered hydrogen sulfide is contacted with the flue gas stream, under catalytic conditions, whereby reaction is effected with sulfur dioxide contained in the flue gas, to provide elemental sulfur, for recovery and use, and an environmentally acceptable inert flue gas stream.

15. The process of claim 1 wherein the gasifying stage is maintained at a bed temperature within the range from about 1650° F. to about 1950° F.

16. The process of claim 1 wherein the heating value of the gaseous fuel product is within the range from about 250 to about 750 B.T.U./s.c.f.

17. The process of claim 16 wherein the heating value of the gaseous fuel product is within the range from about 300 to about 500 B.T.U./s.c.f.

18. The process of claim 1 wherein the superatmospheric pressure is within the range from about 5 to about 50 p.s.i.g.

19. The process of claim 18 wherein the superatmospheric pressure is within the range from about 10 to about 25 p.s.i.g.

20. The process of gasifying sulfur-containing clean coal particles at a low superatmospheric pressure, wherein the coal particles are converted to an environmentally suitable gaseous fuel product and a substantially non-combustible ash in a series of stages, comprising the steps of:

(a) heat treating dried coal particles at a temperature within the range from about 400° to about 700° F.;

(b) devolatilizing the heat-treated coal particles at a temperature within the range from about 850° to about 1150° F., to yield an overhead volatiles stream and devolatilized coal.char particles;

(c) calcining the devolatilized coal char particles in an expanded bed at a bed temperature within the range from about 1550° to about 1750° F., in contact with steam and a gaseous stream comprising an oxygen-containing gas, to yield an overhead calciner effluent gas stream and carbon-rich calcined coke particles;

(d) gasifying the calcined coke particles in an expanded bed at a bed temperature within the range from about 1650° F. to about 1950° F., in contact with steam, to yield an overhead gasifier gas stream and carbon-lean coke particles;

(e) transferring the overhead volatiles stream and the overhead gasifier gas stream to an upper zone of the calcining stage, whereby the respective streams and the calciner gas react further in contact with steam and the oxygen-containing gas and are mixed to form the calciner effluent gas stream;

(f) cooling and scrubbing the calciner effluent gas stream to provide a normally liquid condensate fraction and a gaseous fuel product stream containing hydrogen sulfide;

(g) transferring the normally liquid condensate fraction to the gasifying stage;

(h) transferring the carbon-lean coke particles to a heat generating stage and generating heat therein by combustion of a portion of the coke in contact with a gaseous stream comprising air, to provide heated coke particles and a flue gas stream containing sulfur dioxide;

(i) transferring a major portion of the heated coke particles to the gasifying stage, whereby requisite heat is supplied for the gasification of calcined coke particles and heated coke particles;

(j) withdrawing a minor portion of the heated coke particles to an agglomeration stage, wherein substantially complete gasification of residual coke is effected by reaction with air and steam at a temperature of at least about 1900° F., to provide a producer gas stream containing hydrogen sulfide;

(k) discharging from the agglomeration stage a substantially non-combustible ash;

(l) extracting and recovering the hydrogen sulfide from the gaseous fuel product stream, to provide an environmentally suitable low-sulfur gaseous fuel product;

(m) catalytically contacting the recovered hydrogen sulfide with the flue gas stream, containing sulfur dioxide, whereby elemental sulfur is produced and recovered; and (n) discharging an environmentally suitable low-sulfur flue gas effluent.

21. The process of claim 20 wherein the gaseous fuel product stream and the producer gas stream are combined prior to the extracting and recovering of hydrogen sulfide therefrom.

22. The process of claim 20 wherein any deficiency in the stoichiometric quantity of sulfur dioxide required for reaction with hydrogen sulfide is supplied by the combustion of the requisite quantity of elemental sulfur product in the heat generating stage.

* * * * *